US005622396A

United States Patent [19]

Neumann

[11] Patent Number: 5,622,396

[45] Date of Patent: Apr. 22, 1997

[54] AUTOMOBILE DOOR LOCK

[75] Inventor: Franz Neumann, Wuppertal, Germany

[73] Assignee: BOMORO Bocklenberg & Motte GmbH & Co. KG, Wuppertal, Germany

[21] Appl. No.: 379,762

[22] Filed: Jan. 27, 1995

[30] Foreign Application Priority Data

Jan. 27, 1994 [DE] Germany ..... 44 02 507.6
Mar. 2, 1994 [DE] Germany ..... 44 06 870.0

[51] Int. Cl.[6] ..... E05C 3/04

[52] U.S. Cl. ..... 292/202; 292/216; 292/DIG. 23

[58] Field of Search ..... 292/202, 216, 292/DIG. 23, DIG. 53, DIG. 54

[56] References Cited

U.S. PATENT DOCUMENTS

| | | | |
|---|---|---|---|
| 4,251,095 | 2/1981 | Marino | 292/202 X |
| 4,647,092 | 3/1987 | Nakamura | 292/216 |
| 4,703,961 | 11/1987 | Weinerman et al. | 292/216 |
| 4,762,349 | 8/1988 | Ikeda | 292/216 |
| 4,906,036 | 3/1990 | James | 292/202 |
| 5,005,882 | 4/1991 | Fukumoto | 292/216 |
| 5,015,020 | 5/1991 | Mizuki | 292/216 |

FOREIGN PATENT DOCUMENTS

| | | |
|---|---|---|
| 0229885A1 | 7/1987 | European Pat. Off. . |
| 0424204 | 4/1991 | European Pat. Off. . |
| 4005369 | 2/1990 | Germany . |
| 3911327 | 10/1990 | Germany . |
| 2261020 | 5/1993 | United Kingdom . |

*Primary Examiner*—Rodney M. Lindsey
*Assistant Examiner*—Monica E. Millner
*Attorney, Agent, or Firm*—Sixbey, Friedman, Leedom & Ferguson, P.C.; David S. Safran

[57] ABSTRACT

An automobile door lock having a lock mechanism, with a variety of levers, and lock elements, like a ratchet (1) and a pawl (2), whereby the lock mechanism has an outer actuation lever (6), cooperating with an operating surface (4) of an outer door handle (5), and a clutch lever (9), cooperating with an outer actuating lever (6). Between the levers, there is provided a bolt connection assembly (12) with a longitudinal slot (13), a retaining bolt (14), and a bias spring (15). With the retaining bolt (14) loosened, the outer actuating lever (6) is moved by means of the bias spring (15), until it contacts the operating surface (4). With retaining bolt (14) tightened, both levers are firmly connected to form a unit which is adjustable by the outer door handle (5). With the automobile door lock not installed, the outer actuation lever (6) is in, or near, an end delivery position opposing the force of the bias spring (15), relative to clutch lever (9), and the retaining bolt (14) is strongly tightened such that the bias spring (15) is not effective. With the automobile door lock installed, the retaining bolt (14) is loosened, so that bias spring (15) is effective, and the outer actuation lever (6) is shifted in the direction towards operating surface (4) of outer door handle (5), up to the point of its contact therewith, forming its operational position. With the outer actuation lever (6) in this position, the retaining bolt (14) is tightened such that both levers (6, 9) are firmly interconnected.

16 Claims, 3 Drawing Sheets

AUTOMOBILE DOOR LOCK

BACKGROUND OF THE INVENTION

1. Field of the Invention

The Invention relates to an automobile door lock having a lock mechanism, with a variety of levers, and lock elements, like a ratchet and a pawl, whereby the lock mechanism has an outer actuating lever operatively cooperating at one end with an outer door handle, and with a clutch lever cooperating with an outer actuating lever and with the pawl.

2. Description of Related Art

A locking device for an automobile door, which, in a simple manner can be installed free of play is known from published German Patent Application No. 40 05 369. In the automobile door lock disclosed there, the retaining bolt of the lock mechanism is loosened during the delivery state of the automobile door lock. The outer actuating lever and the clutch lever are spread apart, as far as possible by the bias spring until the farthermost possible end position of the outer actuating lever is reached. Subsequent to the installation of the automobile door lock, the outer door handle is inserted by initially placing a hock, which is in front in the drive direction, into the door panel through an opening, and the door handle is then moved forward until a stop is reached. Thereafter, the rear handle section is twisted into the opening, whereby the outer door handle is guided along the edge of the opening. This guidance is necessary so that a hook-like section passes the outer actuating lever until the outer actuating lever rests at an abutment surface of the outer door handle. A further pressing of the outer door handle into the opening, until it makes contact with the door panel of the automobile door, causes the abutment surface to move the outer actuating lever, opposing the bias force of the bias spring, whereby the relative position of the outer actuating lever is changed, relative to the clutch lever, which remains in a stationary position. An influencing of the pawl does not occur. Subsequently, after the outer door handle is slid rearwardly, and this operational position has thus been fixed, the retaining bolt is tightened, so that now the new position of the outer actuation lever, relative to the clutch lever, is fixed. Accordingly, the lock connection assembly has been fixed, practically free of play. An operating surface of the outer door handle positioned opposite to the abutment surface now is positioned to transmit the opening force to the outer actuating lever when the door is opened.

It is further known (German Patent 39 11 327) to tighten the retaining bolt of the lock connection assembly in the delivery position, and to fix the two levers mentioned above towards each other; to loosen the retaining bolt, subsequent to the installation of the automobile door lock and the insertion of the outer door handle, to bring the outer door handle into its operational position while taking along the outer actuation lever; to fix it in this position, and then to retighten the retaining bolt of the lock mechanism assembly.

The automobile door locks mentioned above, and the installation process outlined in the above description, absolutely require that the automobile door lock be first installed in the automobile door, and that only then the outer door handle is mounted. An installation process in reverse, which sometimes is desirable, is not realizable with this method. It, too, requires the presence of the outer door handle during the installation movement into the door panel to shift the outer actuating lever from its delivery position into its operational position.

Moreover, the necessity to have an abutment surface to move the outer actuating lever against the bias force of the bias spring makes the construction of the outer door handle with its hook-like section rather complicated. This means production costs for the outer door handle to increase.

In addition to the problems mentioned above, there is a considerable tolerance problem during the installation of the outer door handle. Very narrow tolerance ranges have to be adhered to, so as to obtain the necessary guidance effect, for accurately targeting the abutment surface.

SUMMARY OF THE INVENTION

In view of the foregoing, it is a primary object of the present invention to provide an automobile door lock which is improved so as to facilitate installation.

It is a further object of the present invention to provide an automobile door lock with reduced production costs in particular related to the outer door handle.

Above mentioned objects are achieved with an automobile door lock having a lock mechanism with a plurality of levers and lock elements, including a ratched and a pawl, an outer actuating lever operatively cooperating at one end with an outer door handle, and with a clutch lever cooperating with the outer actuating lever on the one hand and with the pawl on the other hand; wherein the outer door handle comprises an operating surface which transmits the opening force from the outer door handle to the outer actuating lever when the door in opened, wherein a lock connection assembly having a retaining bolt and a bias spring is provided between the outer actuating lever and the clutch lever, the outer actuating lever being prestressed toward said operating surface by the bias spring; wherein with the retaining bolt loosened the outer actuating lever is able to contact said operating surface, and the outer actuating lever and the clutch lever are firmly interconnected to form a unit in which they are displaceable together by the outer door handle with the retaining bolt tightened; wherein the outer actuating lever has a delivery end position, in which it is held against the force of the bias spring and relative to the clutch lever by the retaining bolt being tightened rendering the bias spring ineffective, when the automobile door lock is not installed in a vehicle door; wherein the automobile door lock, with the outer actuating lever in said delivery end position is installable into the vehicle door; and wherein, with the automobile door lock installed in the vehicle door, the retaining bolt is releasable for rendering the bias spring effective, and for enabling the outer actuating lever to be displaced toward said operating surface of the outer door handle up to a point of contact therewith into an operational position; and wherein the retaining bolt is tightenable, firmly interconnecting the outer actuating lever and the clutch lever, when the outer actuating lever is in said operational position.

A significant aspect of the invention lies in the "self-aligning" outer actuating lever. Now, it is not the movement of the outer door handle, occurring during the installation, which shifts the outer actuating lever into its operational position. Instead, the outer actuating lever is completely independent from the outer door handle, and its end is far removed from the abutment surface at the outer door handle during installation of the automobile door lock into the automobile door. Only in the installed condition of the automobile door lock, and after loosening of the retaining bolt, does the outer actuating lever automatically align itself, under the effect of the spring force, towards the operating surface of the outer door handle.

It is the fact that the outer actuating lever is automatically aligning under the effect of the spring force toward the operating surface of the outer door handle that is essential for the result of the present invention. It is not the abutment surface of the outer door handle that is used for alignment of the outer actuating lever as in the prior art. In fact such additional abutment surface is no longer needed on the outer door handle so that the shape of the outer door handle may be greatly simplyfied. The operating surface on the outer door handle which is necessary anyway to transmit the opening force from the outer door handle to the outer actuating lever when the door is opened, now, according to the invention, is used for the purpose of aligning the outer actuating lever during installation, too.

This assembly technique is extraordinarily advantageous, as the assembly time at the line is markedly reduced, and moreover, it is entirely inconsequential, now, whether the outer door handle is installed into the automobile door before or after the automobile door lock. Accordingly, the inventive automobile door lock can be uniformly installed without regard to installation technique sequence.

These and further objects, features and advantages of the present invention will become apparent from the following description when taken in connection with the accompanying drawings which, for purposes of illustration only, show a single embodiment of the present invention.

DETAILED DESCRIPTION OF THE PREFERRED EMBODIMENTS

Figure 1:
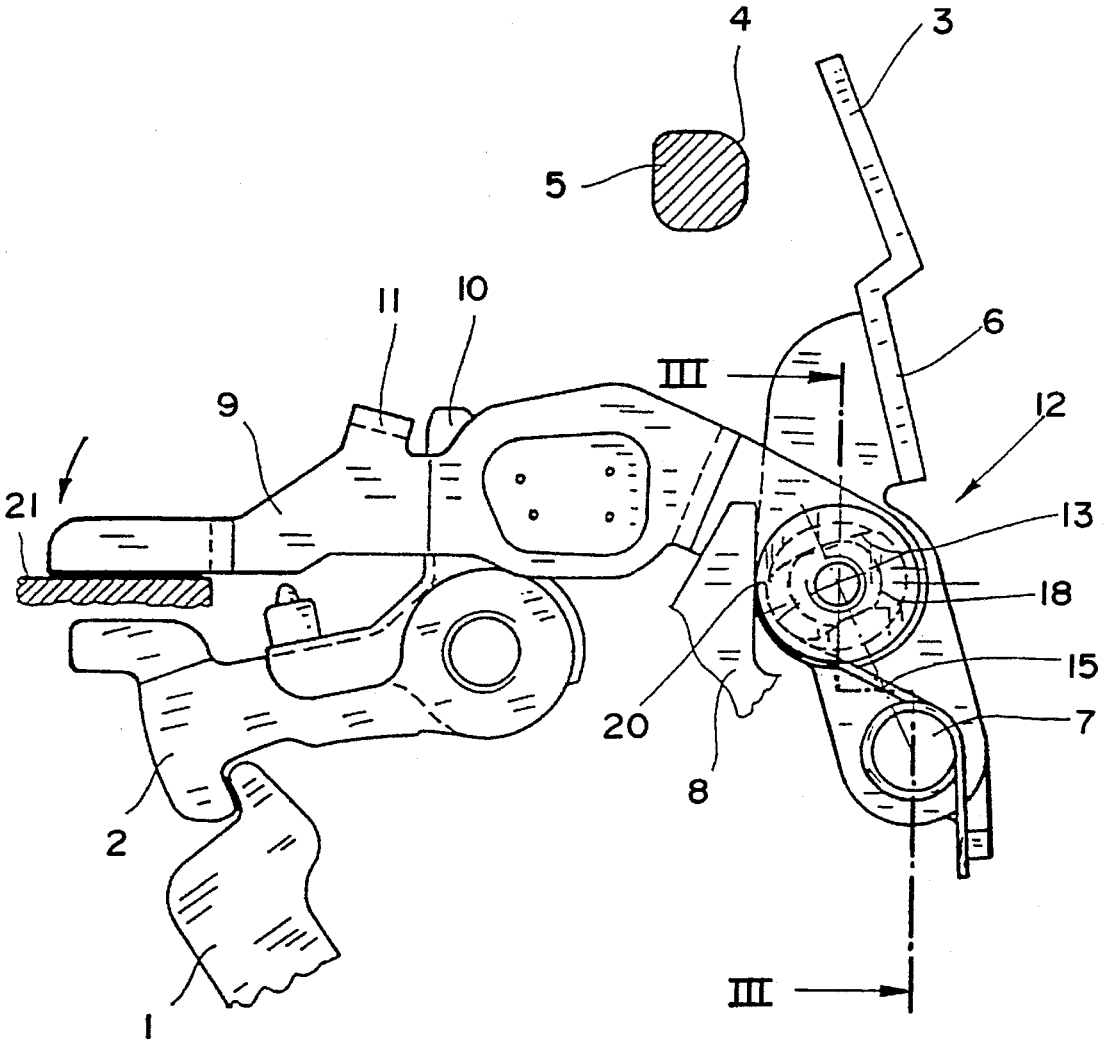
FIG. 1 shows a sectional view of the automobile door lock, already installed into an automobile door, in its delivery condition.

The automobile door lock, sectionally depicted in FIG. 1, comprising a lock mechanism and lock elements having various levers, includes a ratchet 1, and a pawl 2. Only those levers of the lock mechanism are depicted, which are deemed essential for better understanding of the concept taught, it being understood that all unillustrated aspects are in accordance conventional door lock constructions. An outer actuating lever 6 is shown which has an end 3 that operationally cooperates with an operating surface 4 of an outer door handle 5, (here depicted in sectional view), and which is pivotally supported by a pivot bearing 7 at an opposite end. Only a portion of the lock housing 8 is shown. A clutch lever 9 cooperates, directly or indirectly, with the outer actuating lever 6, and with the pawl 2.

It is to be understood that the operating surface 4 in operation transmits the opening force from the outer door handle 5 to the outer actuating lever 6 when the door is opened. In other words, when the outer door handle 5 is pulled to the right in FIG. 1 and 2 which is the direction of movement of the outer door handle 5 when the door is opened, the operating surface 4 is acting to transmit the necessary opening force to the outer actuating lever 6 as can be seen in FIG. 2.

Figure 2:
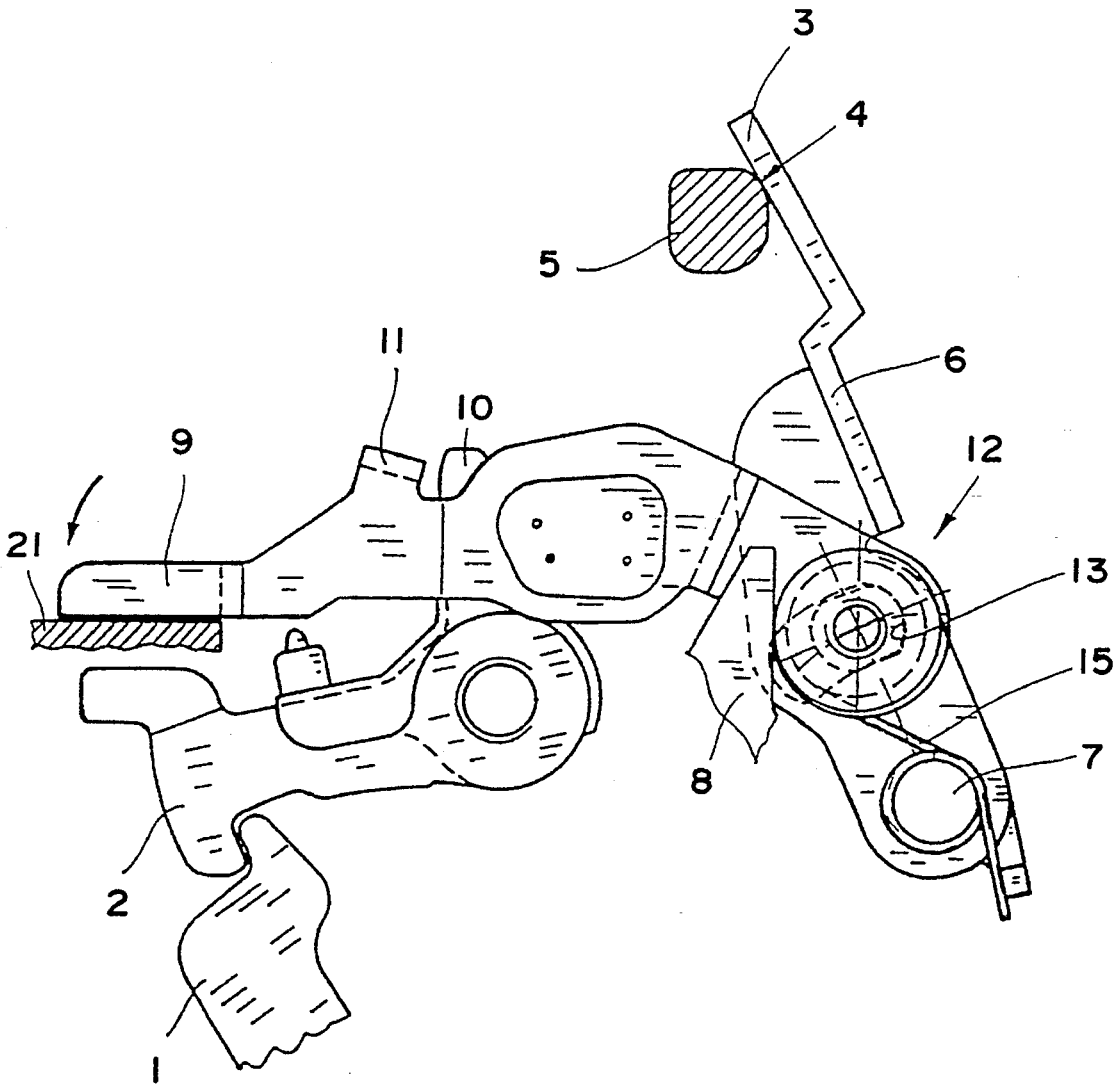
FIG. 2 shows the automobile door lock of FIG. 1, with the outer activating lever in its operating condition.
Figure 3:
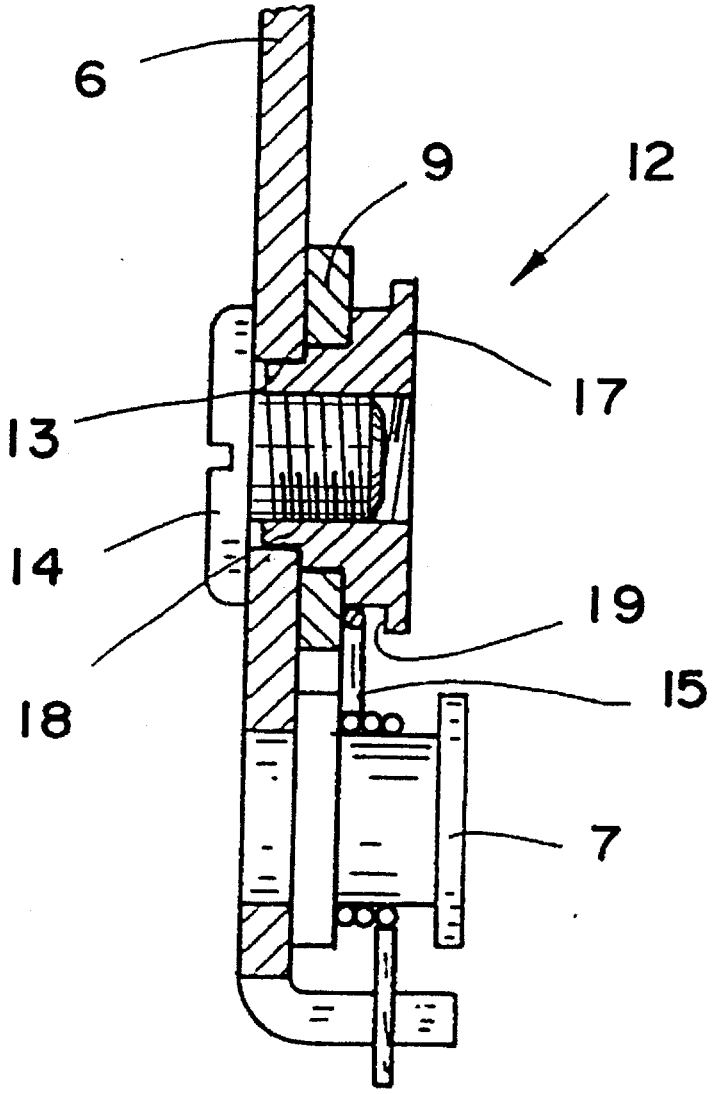
FIG. 3 is a section taken along line III—III, in FIG. 1.

In the example depicted, pawl 2 has an upwardly projecting extension 10, which, upon movement of clutch lever 9 to the right in FIG. 2, is acted upon by an angular driving lug 11 of clutch lever 9. This movement of clutch lever 9 is caused by outer actuating lever 6. To this end, a bolt connection assembly 12, having a longitudinal slot 13, retaining bolt 14, and bias spring 15, is provided between outer actuating lever 6 and clutch lever 9 (FIG. 3). By the effect of bias spring 15, outer actuating lever 6 is prestressed towards operating surface 4, i.e., toward its FIG. 2 position. With retaining bolt 14 loosened, outer actuating lever 6 is moved until it contacts operating surface 4 of outer door handle 5. With retaining bolt 14 tightened, both levers 6 and 9 are firmly interconnected to form a unit, and are movable in unison by outer door handle 5. If outer door handle 5 is pulled to the fight from the point depicted in FIG. 2, opening force is transmitted by operating surface 4 to the outer actuating lever 6, outer actuating lever 6 is rotated around pivot bearing 7 in a clockwise manner, clutch lever 9 is pulled to the right, and, via its drive lug 11, takes along extension 10 of pawl 2 in a clockwise manner, thus releasing it from locking engagement with ratchet 1 (opening door).

When clutch lever 9 is firmly connected with outer actuating lever 6, by tightening of retaining bolt 14, clutch lever 9 is arcuately pulled to the right. However, the firm connection of clutch lever 9 with the outer actuating lever 6 only relates to their ability to slide along the path defined by the longitudinal slot 13, and not, however, to pivoting of the clutch lever 9 around its pivot axis, constituted by the bolt connection assembly 12. In that instance, clutch lever 9 remains unchanged, being pivotable towards outer actuating lever 6, even with the retaining bolt 14 tightened, so that it does not swing during pivoting of the outer actuating lever 6, but only performs a straight-line sliding movement, i.e. so to speak, counter-rotates back around the pivot axis, relative to outer actuating lever 6. From the standpoint of the present invention, this still constitutes a firm connection of both levers 6, 9, due to the fact that outer actuating lever 6 takes clutch lever 9 along with it.

With the automobile door lock not yet installed in the vehicle door, the outer actuating lever 6 is shifted into, or near, its end position relative to clutch lever 9 (delivery position), opposing the force of bias spring 15. In this position, retaining bolt 14 is tightened so strongly that the bias spring 15 becomes ineffective. With the automobile door lock and outer door handle 5 installed, and retaining bolt 14 is subsequently loosened, so that outer actuating lever 6, under the effects of bias spring 15, automatically aligns itself on outer door handle 5, i.e., at its operating surface 4. It is, then, necessary to strongly retighten retaining bolt 14 to again firmly interconnect the two levers 6, 9 (in the sense outlined above) in this operational position. Any additional abutment surface for alignment which was necessary in the prior art is not necessary in the present automobile door lock.

Clutch lever 9 can be pivotally supported with the outer actuating lever 6 on the same pivot bearing 7, as is the case in the initially described construction of the known automobile door lock. Such a construction, in which bolt connection assembly 12 then only serves to fix the two levers 6, 9, to each other, is also shown in German Patent Application 39 11 327. However, the example presently depicted shows another construction, in which, in a particularly advantageous manner, the bolt connection assembly 12, simultaneously, assumes the bearing function for the clutch lever 9 at outer actuating lever 6. To this end, it is provided that retaining bolt 14 cooperates with a threaded nut 17, which has a middle segment 18 with flattened guide edges at the periphery of longitudinal slot 13, and which is guided with almost torsional resistance. Basically, the correlation of longitudinal slot 13 and that of threaded nut 17 to one or the other lever 6, 9, respectively, noncritical. In the example depicted, the longitudinal slot 13 is located in the outer actuating lever 6, while the threaded nut 17 penetrates a circular opening in clutch lever 9.

The details of the construction can be seen in FIG. 3. Pivot bearing 7 is clearly shown there, and bias spring 15 is shown coiled as a leg spring, engaging groove 19 of threaded nut 17 (see also FIGS. 1 and 2).

Together, FIGS. 1 and 2 show that the unit comprising outer actuation lever 6 and clutch lever 9 is pretensioned by means of its own bias spring 22, against a stationary abutment 20 of housing 8 of the automobile door lock, and thus, otherwise untensioned, assumes a certain rest position (locking position of pawl 2). It can be seen in particular in FIG. 1 how that bias spring 22 is coiled as a leg spring, engaging a lug 23 on the clutch lever 9 with one leg and a stop block 24 with the other leg.

It is conceivable to provide that clutch lever 9, at outer actuating lever 6, is only slidably mounted relative to the path of longitudinal slot 13, but is not pivotally attached. This would result in clutch lever 9 performing the above mentioned arcuate movement. However, in the depicted example, it is provided that the firm connection between clutch lever 9 and the outer actuating lever 6 merely refers to slidability along the path of longitudinal slot 13, and does not relate to the pivotability of clutch lever 9 around the pivot axis, constituted by bolt connection assembly 12.

In other words, clutch lever 9 is also pivotable towards outer actuating lever 6, even with retaining bolt 14 tightened. The pivot axis for clutch lever 9, in this instance, is constituted by threaded nut 17. The objective, outlined before, is achieved when clutch lever 9 is locked on threaded nut 17, or is otherwise retained. If clutch lever 9 is not locked on the threaded nut 17, or is not otherwise retained, it is logically capable of being pivoted around threaded nut 17. This is advantageous for activation purposes, or as a means for special theft proofing, and in each instance results in clutch lever 9 being shifted laterally only during a pivotal movement of outer actuating lever 6.

In order to definitely achieve this, it is provided that, in the illustrated example, clutch lever 9 is pretensioned by means of its own bias spring 22 around the pivot axis against a stationary abutment 21 at housing 8, and, accordingly, otherwise unaffected, is shifted laterally only during pivotal movement of outer actuating lever 6. The bias spring 22 indicated as to its effect by an arrow at the left end of clutch lever 9 in FIGS. 1 and 2. The bias spring 22 here in the same spring effecting the pretensioning towards stationary abutment 20. Stationary abutment 21 differs in it function, and, consequently, is separated from abutment 20.

The installation process is such that, with the automobile door lock initially not installed, outer actuation lever 9 is shifted against the force of bias spring 15 into, or near, its end position relative to clutch lever 9 (delivery position), and thereafter, retaining bolt 14 is tightened, so that bias spring 15 is rendered ineffective. It is further provided that the automobile door lock is installed into the automobile door with the outer actuating lever 6 in this delivery position, and after the automobile door lock is installed, the retaining bolt 14 is loosened, so that the bias spring 15 again becomes effective, and now shifts outer actuating lever 6 towards operating surface 4 of the outer door handle 5 until end 3 makes contact there in the operational position. Thereupon, the retaining bolt 14 is tightened to such a degree that both levers 6, 9, are again firmly interconnected (in the sense outlined above). The delivery condition of the automobile door lock at the start of the installation is shown in FIG. 1, and the final condition, with the operational position reached, can be seen in FIG. 2. While only a single embodiment in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. Automobile door lock having a lock mechanism with a plurality of levers and lock elements, including a ratchet and a pawl, an outer actuating lever having an end for cooperating with an outer door handle, and with a clutch lever cooperating with the outer actuating lever on the one hand and with the pawl on the other hand; wherein a lock connection assembly having a retaining bolt and a bias spring is provided between the outer actuating lever and the clutch lever, the outer actuating lever being prestressed in a direction toward an operating position by the bias spring; wherein the automobile door lock is installed in a vehicle door with the outer actuating lever in a delivery end position in which the outer actuating lever is held against the force of the bias spring and is firmly connected with the clutch lever by the retaining bolt being in a tightened condition rendering the bias spring ineffective; and wherein the retaining bolt is loosenable for rendering the bias spring effective and for enabling the outer actuating lever to be displaced solely under the action of said bias spring into its operational position, the retaining bolt being re-tightenable in said operational position for firmly interconnecting the outer actuating lever and the clutch lever for movement together.

2. Automobile door lock according to claim 1, wherein an outer door handle is provided which has an operating surface for transmitting an opening force from the outer door handle to the outer actuating lever for opening of the vehicle door, said outer actuating lever being out of engagement with said outer door handle in said delivery position and being in engagement with the operating surface of the outer door handle in said operational position for displacement thereby.

3. Automobile door lock according to claim 2, wherein said operating surface of the outer door handle is on a closed external portion of the outer door handle.

4. Automobile door lock having a lock mechanism with a plurality of levers and lock elements, including a ratchet and a pawl, an outer actuating lever having an end for operatively cooperating with an outer door handle, and with a clutch lever cooperating with the outer actuating lever on the one hand and with the pawl on the other hand; wherein a lock connection assembly having a retaining bolt and a bias spring is provided between the outer actuating lever and the clutch lever, the outer actuating lever being prestressed relative to the clutch lever by the bias spring in a direction from a delivery position in which it is installable in a motor vehicle door without said door handle toward an operational position for cooperating with the outer door handle after installation thereof; wherein the outer actuating lever is in said delivery end position in which the outer actuating lever is held against the force of the bias spring and is firmly connected with the clutch lever by the retaining bolt being in a tightened condition rendering the bias spring ineffective; wherein the retaining bolt is loosenable for rendering the bias spring effective and for enabling the outer actuating lever to be displaced solely under the action of said bias spring into said operational position, the retaining bolt being re-tightenable in said operational position for firmly interconnecting the outer actuating lever and the clutch lever for movement together.

5. Automobile door lock according to the claim 1, wherein the outer actuating lever is pivotally supported at an opposite end on a pivot bearing.

6. Automobile door lock according to claim 1, wherein the lock connection assembly further comprises a longitudinal slot, and forms a means by which the clutch lever is pivotable at the outer actuating lever around a pivot axis constituted by the lock connection assembly, even with the retaining bolt tightened, while being constrained to slide along said longitudinal slot with the outer actuating lever, the firm connection of the clutch lever with the outer actuating lever being firm only with respect to the ability of the clutch member to slide along said longitudinal slot.

7. Automobile door lock according to claim 6, wherein the lock connection assembly also includes a threaded nut that cooperates with the retaining bolt threaded nut and which has a middle section having flattened leading edges at edges of the longitudinal slot, said middle section being closely guided in said longitudinal slot.

8. Automobile door lock according to claim 7, wherein the threaded nut of the lock connection assembly forms the pivot axis of the clutch lever at the outer actuating lever.

9. Automobile door lock according to claim 8, wherein the unit of the outer actuating lever and the clutch lever is prestressed by means of a second bias spring against a stationary abutment on the housing and into a resting position in which the pawl is in a locking position with respect to said ratchet.

10. Automobile door lock according to claim 9, wherein the clutch lever is pretensioned around the pivot axis against a second stationary abutment of the housing and thus, without other influence, is only laterally displaced during pivotal movement of outer actuating lever.

11. Automobile door lock according to claim 1, wherein the unit of the outer actuating lever and the clutch lever is prestressed by means of a second bias spring against a stationary abutment on the housing and into a resting position in which the pawl is in a locking position with respect to said ratchet.

12. Automobile door lock according to claim 11, wherein the clutch lever is pretensioned around the pivot axis against a second stationary abutment of the housing and thus, without other influence, is only laterally displaced during pivotal movement of outer actuating lever.

13. Automobile door lock according to claim 4, wherein the unit of the outer actuating lever and the clutch lever is prestressed by means of a second bias spring against a stationary abutment on the housing and into a resting position in which the pawl is in a locking position with respect to said ratchet.

14. Automobile door lock according to claim 13, wherein the lock connection assembly further comprises a longitudinal slot and forms a means by which the clutch lever is pivotable at the outer actuating lever around a pivot axis constituted by the lock connection assembly, even with the retaining bolt tightened, while being constrained to slide along said longitudinal slot with the outer actuating lever, the firm connection of clutch lever with the outer actuating lever being firm only with respect to the ability of the clutch member to slide along said longitudinal slot.

15. Automobile door lock according to claim 14, wherein the lock connection assembly also includes a threaded nut that cooperates with the retaining bolt threaded nut and which has a middle section having flattened leading edges at edges of the longitudinal slot, said middle section being closely guided in said longitudinal slot.

16. Automobile door lock according to claim 15, wherein the threaded nut of the lock connection assembly forms the pivot axis of the clutch lever at the outer actuating lever.

* * * * *